US006135403A

United States Patent [19]

Goldstein

[11] Patent Number: 6,135,403

[45] Date of Patent: Oct. 24, 2000

[54] MOUNTS FOR PARALLEL CURTAIN RODS WITH ADJUSTABLE SPACING

[75] Inventor: Allan Goldstein, New York, N.Y.

[73] Assignee: Source Global Enterprises, Inc., Bronx, N.Y.

[21] Appl. No.: 09/238,010

[22] Filed: Jan. 26, 1999

Related U.S. Application Data

[60] Provisional application No. 60/073,428, Feb. 2, 1998.

[51] Int. Cl.[7] ..... A47H 1/14

[52] U.S. Cl. ..... 248/253; 248/265

[58] Field of Search ..... 248/253, 263, 248/256, 257, 258, 260, 265, 272, 296.1, 255, 264, 279.1, 283.1, 286.1, 292.14; 160/368.1, 903, DIG. 6, DIG. 15

[56] References Cited

U.S. PATENT DOCUMENTS

| | | | |
|---|---|---|---|
| 978,095 | 12/1910 | Willet | 248/265 |
| 2,185,385 | 1/1940 | Rose | 248/265 |
| 2,484,855 | 10/1949 | Press | 248/263 |
| 2,561,157 | 7/1951 | Trimarchi et al. | 211/103 |
| 2,998,955 | 9/1961 | Hertzog | 248/263 |
| 3,030,060 | 4/1962 | Breuer | 248/265 |
| 3,241,684 | 3/1966 | Willsey | 211/105.1 |
| 3,567,261 | 3/1971 | Akczinski | 403/106 |
| 5,564,666 | 10/1996 | Pfeil | 248/263 |

*Primary Examiner*—Ramon O. Ramirez
*Assistant Examiner*—N. Sanders
*Attorney, Agent, or Firm*—Levine & Mandelbaum

[57] ABSTRACT

A mount for supporting the ends of parallel hung curtain rods has telescoping male and female members pivotally mounted on a base with a tensioning screw. Connectors for receiving the ends of the curtain rods are mounted on remote ends of the telescoping male and female members. The distance between the connectors and the angle of an axis intersecting the connectors can be adjusted by loosening the tensioning screw and then tightening it to fix the connectors and, hence, the curtain rods in a desired disposition.

6 Claims, 4 Drawing Sheets

MOUNTS FOR PARALLEL CURTAIN RODS WITH ADJUSTABLE SPACING

This application claims benefit of provisional application No. 60/073,428 Feb. 2, 1998.

BACKGROUND OF THE INVENTION

The present invention relates to mounts for curtain rods which may be hung in parallel to support two sets of curtains, one set behind the other set. More specifically, the invention includes an apparatus for mounting parallel curtain rods and providing for adjustment of the spacing between them to accommodate different thicknesses and desired spacing of curtains, before or after the rods are mounted.

It is known in the art to employ telescoping curtain rods having a substantially rectangular cross-section and inwardly extending ends each of which has a slot for receiving a tine projecting from a fixed bracket which is mounted on a wall, usually through the use of one or more screws. Where dual curtain rods are to be mounted in parallel to support two sets of curtains, the bracket is provided with two tines, each one for supporting an end of a different one of two respective curtain rods. Such prior art curtain rods cannot be rotated relative to the bracket. As a result, the spacing between the curtain rods is fixed by the spacing between the tines on the bracket.

Depending on the thickness of the curtain material, and the desired effect, it is advantageous to be able to decrease or increase the spacing between the curtains. Moreover, it is sometimes beneficial to hang one set of curtains with a wider span than the other, e.g., where the outer edges of the inner set of curtains is to be hidden by the outer set of curtains. Also, it may be desirable to have the curtain rods at different heights, depending on how the curtains are sewn, and their length.

SUMMARY OF THE INVENTION

Applicant's invention overcomes to the afore stated limitations of the prior art by providing two parallel curtain rods with mounts having a base on which there are rotatable members adapted for receiving the rods. In a first preferred embodiment of the invention, the curtain rods have ends with circular cross-sections. A mount for receiving the cylindrical ends of the curtain rods is provided with two spaced bosses each of which is attached to a different one of two telescoping members and rotatable in a common plane, parallel to a wall in front of which curtains are to be hung, about an axis, between the bosses, intersecting a base of the mount.

In a second embodiment of the invention which can be used with conventional curtain rods of substantially rectangular cross section, brackets with tines are rotatably mounted on the members in place of the bosses. The tines can be received in slots adjacent the ends of the curtain rods, i.e., where the tines of a conventional curtain rod bracket would normally be received, for permitting the brackets to be rotated relative to the bases of the mounts for varying the spacing between the curtain rods.

DESCRIPTION OF THE PREFERRED EMBODIMENT

Figure 1:
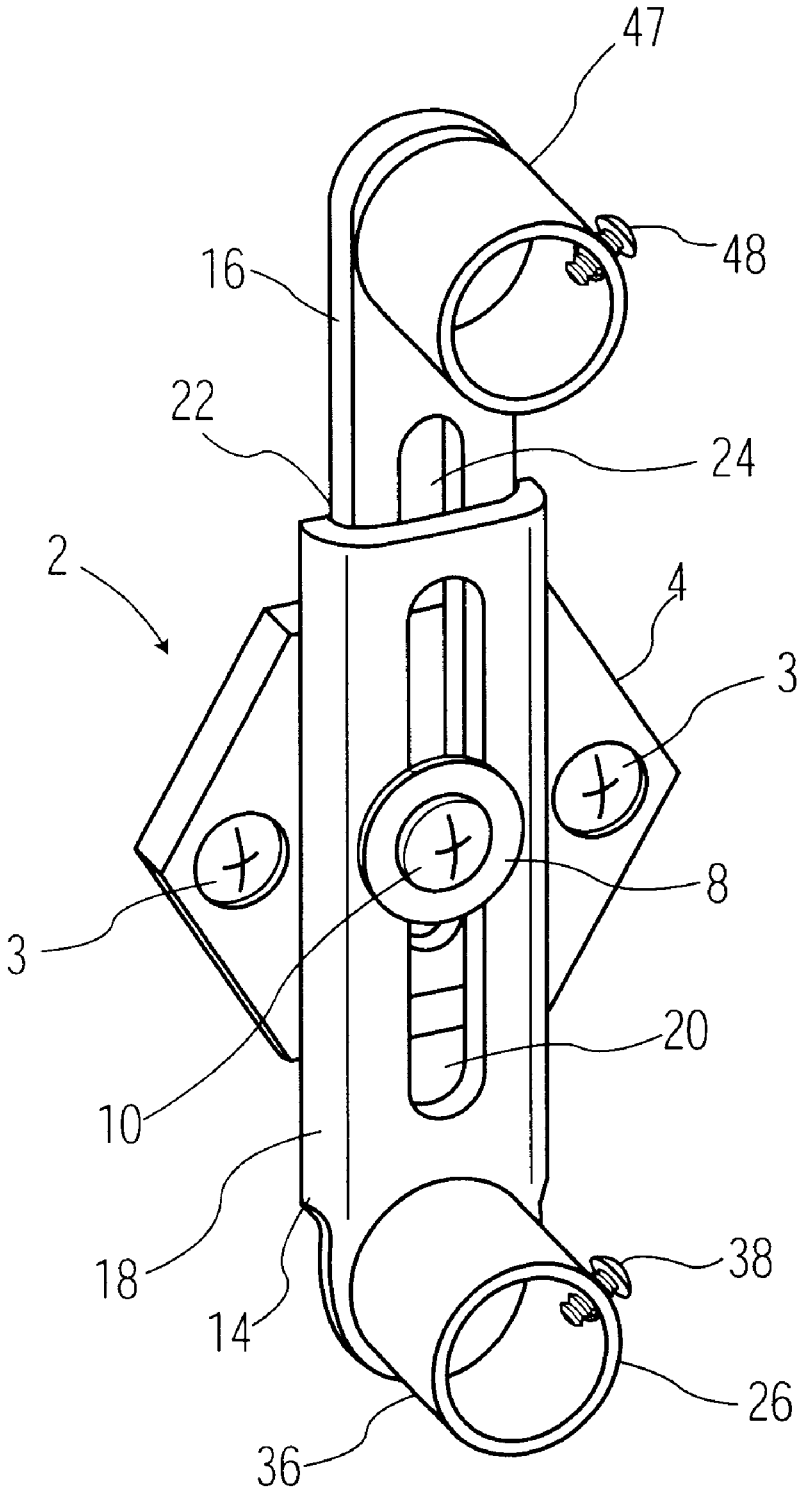
FIG. 1 is a perspective view of a first preferred embodiment of the invention.
Figure 2:
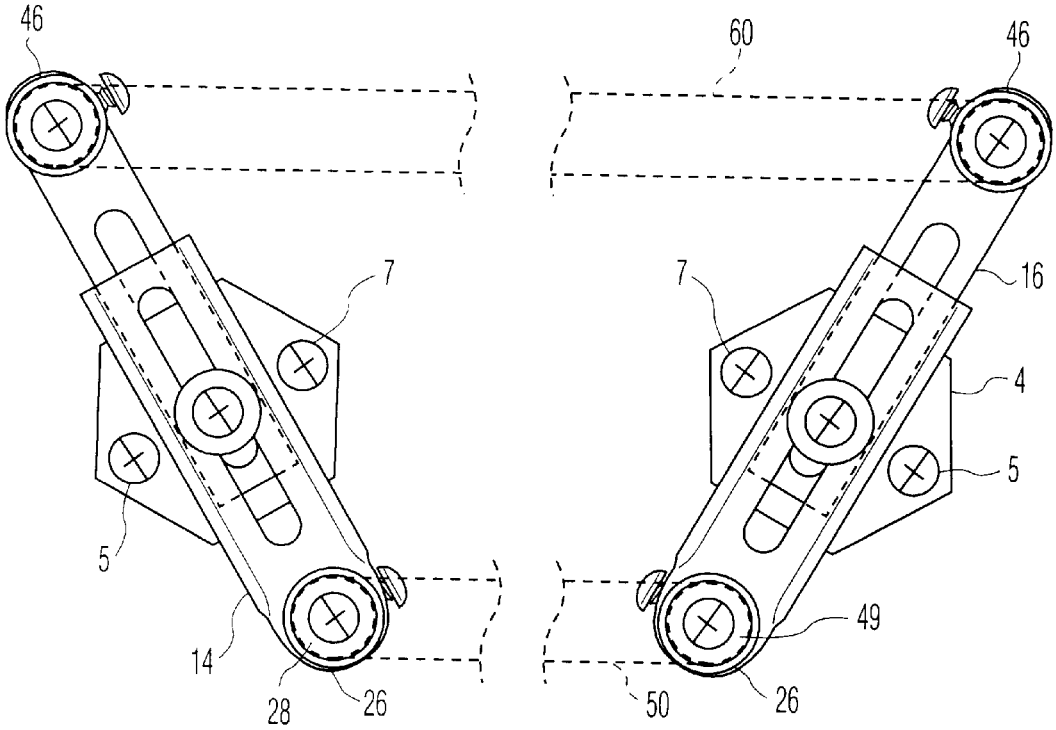
FIG. 2 is an elevation view of the first preferred embodiment of the invention in use.
Figure 3:
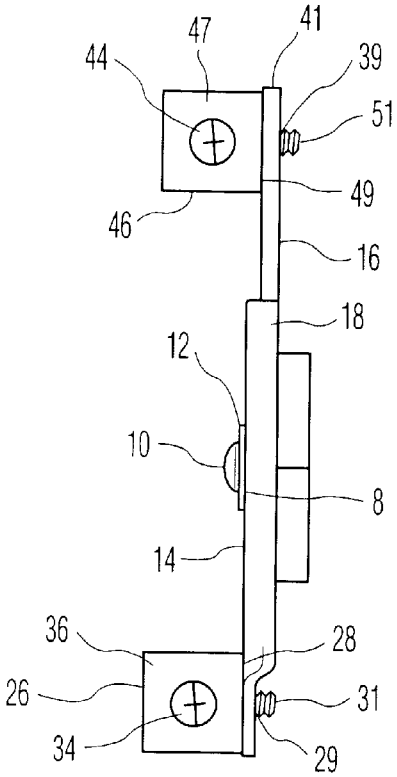
FIG. 3 is a side elevation view of the first preferred embodiment of the invention.

Referring now to FIGS. 1–3 of the drawings, there is shown a mount 2 which has a hexagonally shaped base 4 with diametrically opposed apertures 3 for receiving screws 5,7 for fixedly mounting the base 4 on the surface of a wall, and a central threaded aperture 8 for receiving a set screw 10 on which there is mounted a washer 12. Telescopically and rotatably mounted on the base 4 are a female slotted, generally rectangular (insofar as it has two parallel straight sides) member 14 and a male, generally rectangular, member 16. The female member 14 has downward projecting walls 18, giving it a generally U-shaped cross section, and an axial opening or slot 20. The male member 16 also has a central axial opening or slot 24 which is in lateral registration with the opening 20 in the female member 14. The width of the male member 16 is just slightly less than the width of a channel 22 in the underside of the female member 14 between the walls 18 for being snugly slidably received within the channel 22 thereby permitting relative translation between the members 14 and 16 in a direction parallel to the axes of the slots 20 and 24, and preventing relative translation between the members 14 and 16 in a direction transverse to the axes of the slots 20 and 24.

As can readily be seen in FIGS. 1 and 2, the male member 14 is mounted on the base 4 and the female member 16 is mounted over the male member 14 with the set screw 10 passing through slots 20 and 24, and the washer 12 proximate the upper surface of the female member 14. With the set screw 10 slightly loosened, the female member 14 and male member 16 can be translated inwardly and outwardly with respect to one another in telescoping fashion, and rotated together about the axis of the aperture 5.

Adjacent one end of the female member 14, in axial alignment with the slot 20, is a threaded aperture 29. Mounted on this end of the female member 14, on an upper surface thereof, is a cylindrical boss 26 which is open at its upper end and closed at its lower end by a bottom end wall 28 having a central aperture through which there is inserted a screw 31 which is threaded into the aperture 29 for fixedly mounting the boss 26 on the female member 14. A threaded aperture 34 is provided in the cylindrical wall 36 of the boss 26 for receiving a set screw 38 which is tightened after insertion of a tubular end of a curtain rod 50 to secure it within the boss 26.

Adjacent and exposed end 41 of the male member 16, in axial alignment with the slot 24, is a threaded aperture 39. Mounted on this exposed end of the male member 16, on an upper surface thereof, is a cylindrical boss 46 which is open at its upper end and closed at its lower end by a bottom end wall 49 having a central aperture through which there is inserted a screw 51 which is threaded into the aperture 39 for fixedly mounting the boss 46 on the male member 16. A threaded aperture 44 is provided in the cylindrical wall 47 of the boss 46 for receiving a set screw 48 which is tightened after insertion of a tubular end of another curtain rod 60 to secure in within the boss 46, normally in parallel disposition to curtain rod 50.

The mounts 2 can be used in pairs to support two parallel curtain rods 50, 60 having tubular or cylindrical ends as best seen in FIG. 2. The curtain rods 50, 60 are preferably of the two-section telescoping type. The space between the curtain rods 50, 60 can be adjusted by loosening the central set screw 10 and rod securing set screws 38, 48 of each mount 2, and then rotating the members 14 and 16 of each mount about the respective bases 4. The members 14 and 16 can also be translated relative to one another along their common axes to increase of decrease the distance between the bosses 26 and 46. Thereafter the set screws 10, 38 and 48 can be tightened to secure the rods 50 and 60 in place.

If it is desired to have two pairs of curtains hung at the same height, one pair within and behind the other, the members 14 and 16 may be rotated to a horizontal position whereat the bosses 26 and 46 are horizontally aligned. Each end of an outer curtain rod 50 may then be inserted into an outer respective boss 26 and each end of an inner curtain rod 60 may then be inserted into an inner respective boss 46.

Virtually an infinite number of combinations of rotation and translation of the members 14 and 16, to achieve a functionally and aesthetically pleasing configuration for two sets of curtains, are possible as will be readily apparent to the user of the invention.

Figure 4:
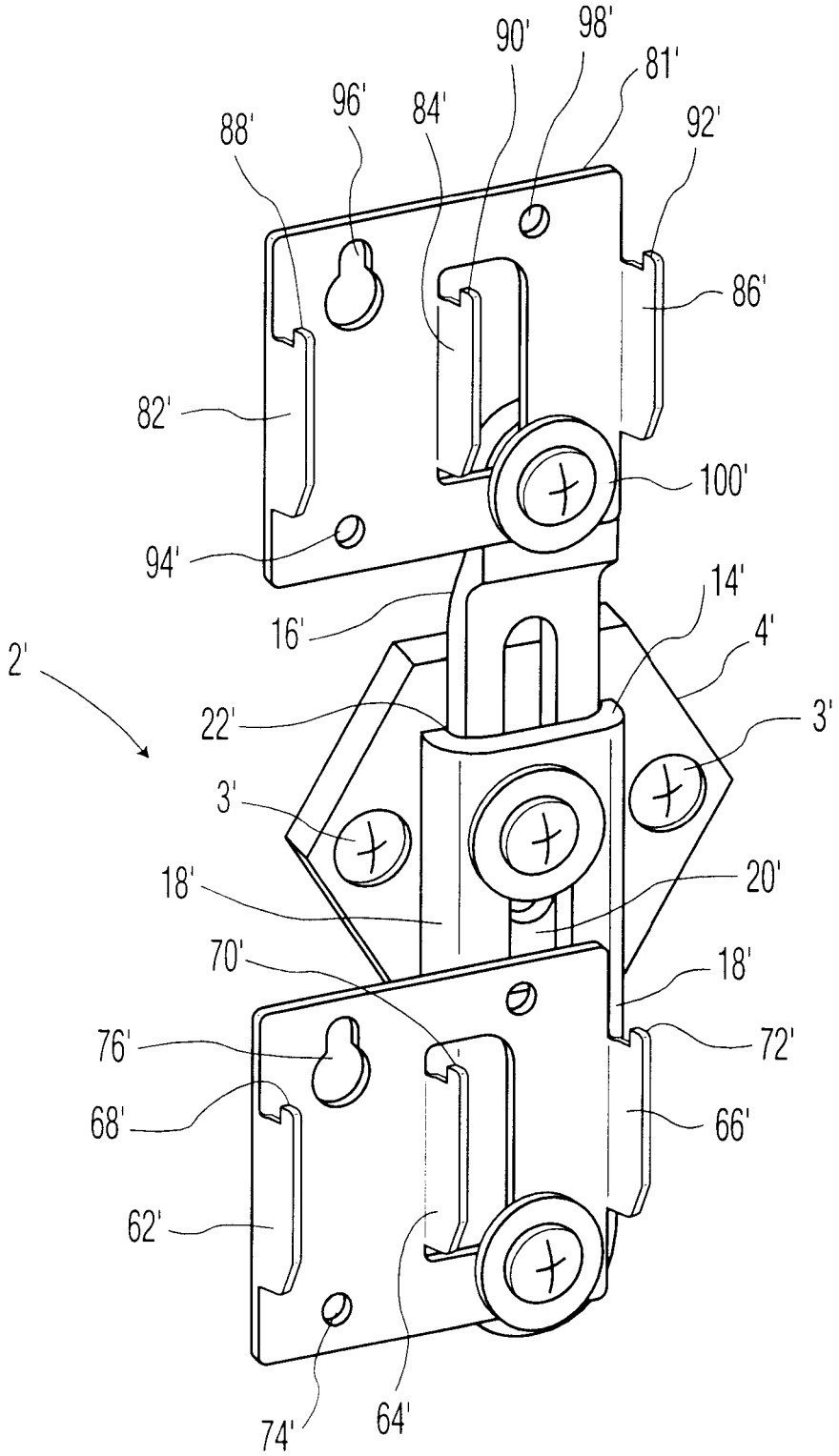
FIG. 4 is a perspective view of a second preferred embodiment of the invention.
Figure 5:
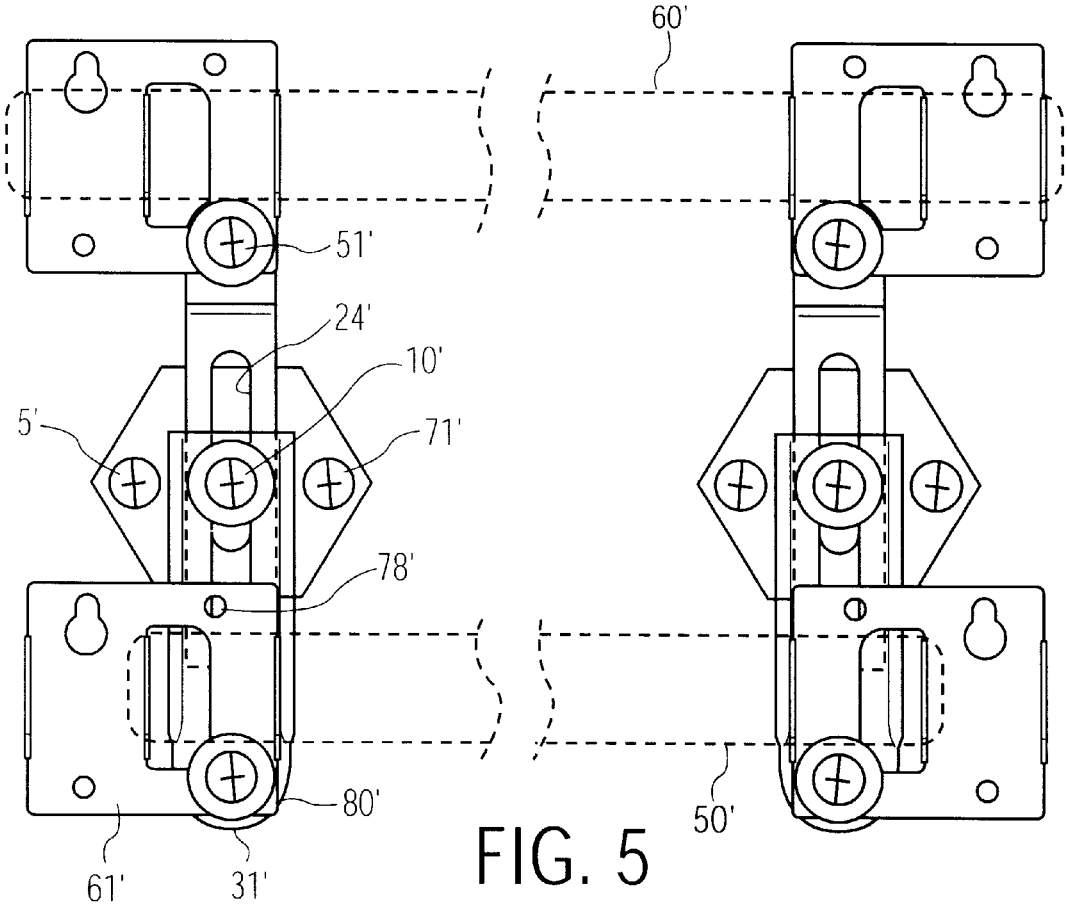
FIG. 5 is an elevation view of the second preferred embodiment of the invention in use.
Figure 6:
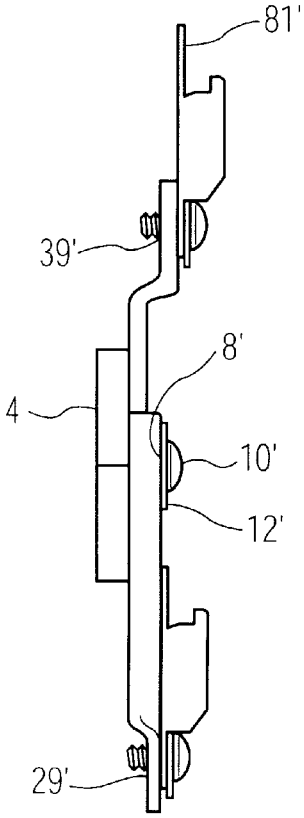
FIG. 6 is a side elevation view of the second preferred embodiment of the invention.

Referring now to FIGS. 4–6, there is shown a second embodiment of the invention for use in supporting conventional bent sheet metal curtain rods of generally rectangular cross section with slotted ends adapted to be received on a tine of a curtain rod bracket.

In the second embodiment of the invention, a mount 2' which has a hexagonally shaped base 4' with diametrically opposed apertures 3' for receiving screws 5',7' for fixedly mounting the base 4' on the surface of a wall, and a central threaded aperture 8' for receiving a set screw 10' on which there is mounted a washer 12'. Telescopically and rotatably mounted on the base 4' are a female slotted, generally rectangular (insofar has it has two parallel straight sides) member 14' and a male, generally rectangular, member 16'. The female member 14' has downward projecting walls 18', giving it a generally U-shaped cross section, and an axial opening or slot 20'. The male member 16' also has a central axial opening or slot 24' which is in lateral registration with the opening 20' in the female member 14'. The width of the male member 16' is just slightly less than the width of a channel 22' in the underside of the female member 14' between the walls 18' for being snugly slidably received within the channel 22' thereby permitting relative translation between the members 14' and 16' in a direction parallel to the axes of the slots 20' and 24', and preventing relative translation between the members 14' and 16' in a direction transverse to the axes of the slots 20' and 24'.

As can readily be seen in FIGS. 4 and 5, the male member 14' is mounted on the base 4' and the female member 16' is mounted over the male member 14' with the set screw 10' passing through slots 20' and 24', and the washer 12' proximate the upper surface of the female member 14'. With the set screw 10' slightly loosened, the female member 14' and male member 16' can be translated inwardly and outwardly with respect to one another in telescoping fashion, and rotated together about the axis of the aperture 8'.

Adjacent one end of the female member 14', in axial alignment with the slot 20', is a threaded aperture 29'. Mounted on this end of the female member 14', on an upper surface thereof, is a conventional, rectangular bracket 61', of the type which has heretofore been fixedly mounted on a wall, preferably made of sheet metal, which has three outwardly bent portions 62', 64', 66' which are shaped to form upwardly extending tines 68', 70', 72'. Adjacent each of four corners of each bracket 61' is an opening 74', 76', 78', 80'. The bracket 61' is fastened to the female member 14' by the screw 31' which is passed through one of the openings 74', 76', 78', 80' and threaded into aperture 29'.

Adjacent one end of the male member 16', in axial alignment with the slot 24', is a threaded aperture 39'. Mounted on this end of the male member 16', on an upper surface thereof, is a conventional rectangular bracket 81', which has three outwardly bent portions 82', 84', 86' which are shaped to form upwardly extending tines 88', 90', 92'. Adjacent each of four corners of each bracket 81' is an opening 94', 96', 98', 100'. The bracket 81' is fastened to the male member 16' by the screw 51' which is passed through one of the openings 94', 96', 98', 100' and threaded into aperture 39'.

The mounts 2' can be used in pairs to support from two parallel conventional curtain rods (one end of one rod on each bracket), as best seen in FIG. 2 to as many as six curtain rods (three ends of three respective rods on each bracket) . The curtain rods are preferably of the conventional two-section telescoping type. The space between two parallel curtain rods can be adjusted by loosening the central set screws 10' and bracket securing set screws 31' and 51', and then rotating the members 14' and 16' in unison about the base 4'. The members 14' and 16' can also be moved relative to one another along their common axes to increase of decrease the distance between the brackets 61' and 81'. Thereafter the screws 10', 31' and 51', can be tightened to secure the rods 50' and 60' in place.

If it is desired to have two pairs of curtains hung at the same height, one pair laterally within and behind the other, the members 14' and 16' may be rotated to a horizontal position whereat the brackets 61' and 81' are horizontally aligned. Each end of up to three outer curtain rods may then be mounted with its slot penetrated by a tine of one bracket 61' and a tine of bracket 81'.

Various combinations of rotation and translation of the members 14' and 16' to achieve a functionally and aesthetically pleasing configuration for two sets of curtains are possible and will be readily apparent to the user of the invention.

It is to be appreciated that the foregoing is a description of two preferred embodiments of the invention to which variations and modifications may be made without departing from the spirit and scope of the invention. For example rotatable connectors for joining the ends of curtain rods to rotatable mounts, other than bosses and tines may be employed, such as clamps, sockets, friction studs and the like.

What is claimed is:

1. A mount for the ends of two or more curtain rods, comprising a base adapted to be mounted on a wall at one side of a window, said base having pivot means mounted thereon, an elongated female member having an axial slot, an elongated male member having an axial slot, said male member being slidably received within said female member, said pivot means being received within said male member slot and said female member slot for selectively enabling relative translation between said male member and said female member and rotation of said male member and said female member about said pivot means, first connector means mounted on one end of said female member, second connector means mounted on one end of said male member distal from said first connector means, each of said first connector means and second connector means comprising attachment means for releasably engaging an end of one of said curtain rods.

2. A mount for the ends of two or more curtain rods according to claim 1 wherein said base has a threaded aperture and said pivot means comprises a screw threaded into said aperture, said screw having a head which, when said screw is tightened, increases friction among said base, male member and female member for simultaneously preventing relative translation between said male member and said female member and rotation of said male member and said female member relative to said base, and when said screw is loosened, decreases friction among said base, male member and female member for permitting relative translation between said male member and said female member and rotation of said male member and said female member relative to said base.

3. A mount for the ends of two or more curtain rods according to claim 1 wherein at least one of said connector means comprises a hollow cylindrical boss for receiving a curtain rod having a substantially cylindrical end.

4. A mount for the ends of two or more curtain rods according to claim 3 wherein at least one of said connector means comprises a bracket having at least one tine for being received within a slot in an end of a curtain rod having a substantially rectangular cross section.

5. A mount for the ends of two or more curtain rods according to claim 4 further comprising secondary pivot means connected between said bracket and a respective member on which said bracket is mounted for selectively enabling and disabling relative rotation between said bracket and said respective member.

6. Apparatus for hanging two sets of curtains on two respective curtain rods, each of which has a left end and a right end, comprising, a left end mount for supporting the left ends of said two curtain rods, and a right end mount for supporting the right ends of said two curtain rods, each of said left end mount and right end mount comprising a base adapted to be mounted on a wall at one side of a window, said base having pivot means mounted thereon, an elongated female member having an axial slot, an elongated male member having an axial slot, said male member being slidably received within said female member, said pivot means being received within said male member slot and said female member slot for enabling relative translation between said male member and said female member and rotation of said male member and said female member about said pivot means, first connector means mounted on one end of said female member, second connector means mounted on one end of said male member distal from said first connector means, said first connector means of said left end mount comprising first attachment means for releasably engaging the left end of one of said curtain rods, said second connector means of said left end mount comprising second attachment means for releasably engaging the left end of another of said curtain rods, said first connector means of said right end mount comprising third attachment means for releasably engaging the right end of said one of said curtain rods, said second connector means of said right end mount comprising fourth attachment means for releasably engaging the right end of said another of said curtain rods, whereby said pivot means can be loosened for adjusting the spacing between said curtain rods by translating said left mount male and female members with respect to one another and rotating said left mount male and female members relative to said left mount base, and translating said right mount male and female members with respect to one another and rotating said right mount male and female members relative to said right mount base.

* * * * *